US006237976B1

(12) United States Patent
Whitt, Jr.

(10) Patent No.: US 6,237,976 B1
(45) Date of Patent: May 29, 2001

(54) HOOK ASSEMBLY AND METHOD OF EXTENDING REACH

(75) Inventor: Robert W. Whitt, Jr., Ardmore, TN (US)

(73) Assignee: Summa Technology, Inc., Huntsville, AL (US)

( * ) Notice: Subject to any disclaimer, the term of this patent is extended or adjusted under 35 U.S.C. 154(b) by 0 days.

(21) Appl. No.: 09/411,967

(22) Filed: Oct. 4, 1999

(51) Int. Cl.[7] ..... B66F 9/00
(52) U.S. Cl. ..... 294/82.1; 414/607
(58) Field of Search ..... 294/1.1, 82.1, 294/82.11, 19.1, 26; 414/607, 722, 723; 901/31, 39; 37/403, 468, 903

(56) References Cited

U.S. PATENT DOCUMENTS 532,321 * 1/1895 Gates ..... 294/82.1
1,045,882 * 12/1912 Price ..... 294/82.1
2,043,460 * 6/1936 Young ..... 294/82.1
2,552,758 * 5/1951 Andersen ..... 294/82.1
3,396,862 * 8/1968 Fischer ..... 414/607
3,409,156 * 11/1968 Mills ..... 414/607
3,930,585 * 1/1976 Lynch ..... 414/607

* cited by examiner

*Primary Examiner*—Dean J. Kramer
(74) *Attorney, Agent, or Firm*—Lanier Ford Shaver & Payne P.C.; David L. Berdan

(57) ABSTRACT

The present invention is directed to a hook assembly and method for extending the reach of transportation load handling systems such as military load handling systems employing hook arms and loading platforms designed to be loaded and unloaded from ISO containers. The hook assembly of the present invention includes a hook member adapted to mate with the load handling platform and a locking assembly extending form the hook member to secure the hook member to the existing hook of a load handling device. Such an assembly extends the reach of the existing hook of the load handling device and is particularly well suited for maintaining engagement with a loading platform. A method of extending the reach of an existing loading device hook is also disclosed.

12 Claims, 7 Drawing Sheets

HOOK ASSEMBLY AND METHOD OF EXTENDING REACH

BACKGROUND OF INVENTION

1. Field of Invention

The present invention relates generally to the field of load handling methods and apparatus, and more particularly to a hook assembly and method for extending the reach of load handling systems presently known in the art.

While the present invention is subject to a wide range of load handling applications, it is particularly well suited for extending the reach of load handling equipment and other devices used to insert and remove palletized loads into and out of International Standards Organization (ISO) containers.

2. Technical Background

ISO containers have long been a standard vehicle for transporting equipment and other goods via air, land, sea, and rail. These containers are durable, rugged in construction, and are sized and shaped such that they are readily and economically securable to rail cars, trucks, ship holds, and cargo bay floors of large aircraft. Sufficiently bracing loads within these containers, however, has proved to be a challenging task.

In view of these load bracing issues, the United States Armed Services is moving toward the employment of a Container Roll-in/out Platform (CROP) as the load/unload platform for equipment and other goods carried in ISO containers The M3 and M3A1 CROP each has a flat cargo body with a folding front end structure assembly designed for use with the Palletized Load System (PLS) truck and trailer. Each is designed to be loaded onto the PLS truck and trailer and into an ISO container using the Load Handling System (LHS). Each is also capable, however, of being transported by other modes of transportation through the supply distribution system in a stand-alone configuration.

A standard M3 CROP weighs approximately 3,800 pounds, while a standard M3A1 CROP weighs approximately 4,000 pounds. The M3 CROP and the M3A1 CROP will accommodate payloads of approximately 32,450 pounds and 32,250 pounds, respectively, when loaded in an ISO container or on a PLS truck or trailer. Thus, although the CROPs are constructed largely of galvanized steel, standard loads for shipment in ISO containers typically cause some amount of bending or sagging in the CROP body or frame. Oftentimes, this bending brings the CROP frame into contact with the bottom of the ISO container. Thus, even though the CROP is typically equipped with rollers for facilitating insertion of the CROP into the ISO container, the frame to bottom contact produces frictional resistance which impedes the insertion of the CROP into the ISO container. The frictional resistance, among other things, acting against the loading force applied to the A-frame by the PLS truck often results in deflection of the A-frame during insertion of the CROP into the ISO container. While this does not generally inhibit CROP insertion at the commencement of CROP onloading, it does pose a problem as the loading process nears completion.

When the A-frame deflection is significant, it has been found that the PLS truck hook arm commonly used to insert the CROP into an ISO container is inadequate to facilitate complete insertion of the CROP into the ISO container. In addition, it has also been determined that the PLS hook arm is often not capable of reaching the A-frame of a CROP that is fully inserted within an ISO container. Generally speaking, the straight portion of the hook arm assembly often strikes the top wall of the ISO container before the CROP is fully inserted, thus inhibiting further insertion of the CROPs or before the hook arm assembly reaches the A-frame of a fully inserted CROP. In such instances, it is often necessary to enlist the aid of other vehicles, such as forklifts to complete CROP insertion or to facilitate CROP removal.

Unfortunately, the use of additional vehicles and manpower is both inefficient and economically costly. Moreover, for many operations, particularly military operations, the use of additional vehicles is impractical. The military relies heavily on the use of ISO containers for shipments to and from forward areas of operation. In many of these forward areas, forklifts and other vehicles simply are not available.

Another shortcoming also relates to deflection of the A-frame. During offloading of the CROP from an ISO container, the heavy loads can cause the A-frame to bend in the direction of the PLS truck as the PLS truck is withdrawing the CROP from the ISO container. As a result, the bail bar attached to the A-frame and grasped by the hook portion of the PLS truck hook arm may slip from the hook resulting in hook disengagement Such unexpected disengagements can cause damage to the hook, the bail bar, the A-frame, and the CROP. In addition, unexpected disengagements often lead to hazardous conditions in the loading area. Unexpected disengagements typically result in the PLS truck lunging forward, which poses a hazard for personnel in the immediate vicinity of the truck.

In view of the foregoing there is a need for an apparatus and method for extending the reach of devices used to insert CROPs into ISO containers and to remove fully loaded CROPs from ISO containers. In addition, there is a need for an apparatus and method that mounts securely to existing equipment such as PLS truck hook arms, and that can securely grasp the bail bar of CROP A-frames to prevent unanticipated disengagements. Such a device should be simple to use, inexpensive to manufacture and maintain, and readily attachable and detachable from existing equipment. It is to the provision of such a device and method that the present invention is primarily directed.

SUMMARY OF INVENTION

One aspect of the present invention relates to an assembly for extending the reach of a loading device. The assembly includes a member having a hook sized and shaped to mate with an apparatus to be loaded, and an elongated locking assembly depending from the member. The locking assembly is constructed and arranged to secure the member to the existing hook of the loading device thereby extending the reach of the existing hook.

In another aspect the present invention is directed to a method of extending the reach of an existing hook of a loading device. The method includes the steps of guiding a hook assembly, including a member having a hook, and a locking assembly depending from the member, onto the existing hook of the loading device. The hook assembly is pivoted with respect to the existing hook such that the locking assembly engages the base of the existing hook, and such that the member receives the tip of the existing hook. The method also includes the step of fastening the hook assembly to the existing hook to prevent unintended separation of the hook assembly from the existing hook.

The apparatus of the present invention results in a number of advantages over other apparatus and methods known in the art. For example, the hook assembly and method of the present invention extends the reach of existing hook arms of vehicles used to insert and withdraw shipping assemblies from transportation containers, such as ISO containers typically used for transporting military equipment. This is preferably accomplished by detachably coupling the hook assembly of the present invention to the existing hook depending from the hook arm of a loading device such as a PLS truck. The novel design of the hook assembly of the present invention enables a user to quickly and easily install the hook assembly without the use of tools. Accordingly, significant time is saved by installing the hook assembly of the present invention when the loading platform cannot be fully inserted into the ISO container. Rather than employing additional loading equipment, as is typically done today, a simple device can be quickly attached to the PLS truck or other vehicle being employed.

In addition, the apparatus and method of the present invention optionally includes a fastener that communicates with the locking assembly to selectively lock the hook assembly into engagement with the existing hook of the loading device. When employed, the hook assembly of the present invention cannot rotate out of engagement with the existing hook. As a result, the hook assembly of the present invention provides a significant improvement over hastily fabricated temporary extension devices that have been used in the past.

Additionally, the hook assembly of the present invention includes a hook that is formed with both forward and rear hook flanges. The flanges are sized and shaped to at least partially surround the bail bar of a CROP. Accordingly, the hook portion of the hook assembly of the present invention actually grasps the bail bar during both onloading and offloading operations. As a result, the hook assembly of the present invention remains in engagement with the bail bar even when the A-frame is deflected due to heavy loads. Slippage is thus prevented, and the number of injuries resulting from failed attempts to maintain the bail bar in engagement with the hook can be significantly reduced.

Additional features and advantages of the invention will be set forth in the detailed description which follows, and in part will be readily apparent to those skilled in the art from that description or recognized by practicing the invention as described herein.

It is to be understood that both the foregoing general description and the following detailed description are merely exemplary of the invention, and are intended to provide an overview or framework for understanding the nature and character of the invention as it is claimed. The accompanying drawings are included to provide further understanding of the invention, illustrate various embodiments of the invention, and together with the description serve to explain the principles and operation of the invention.

DETAILED DESCRIPTION OF THE PREFERRED EMBODIMENTS

Figure 1:
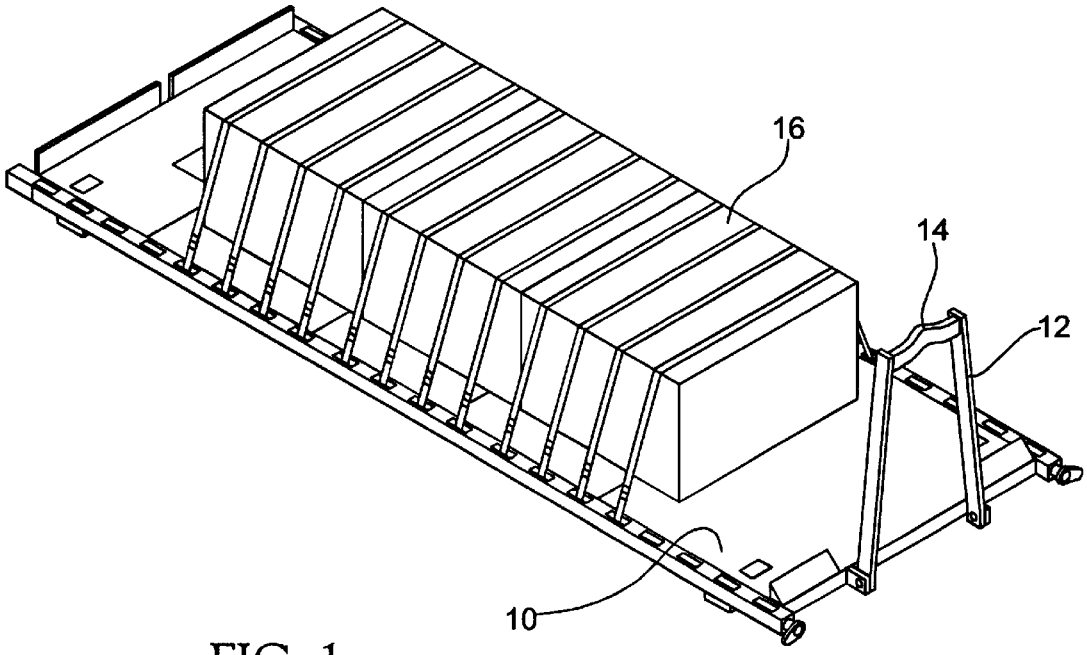
FIG. 1 is a perspective view of an M3 CROP shown in a loaded configuration.
Figure 2:
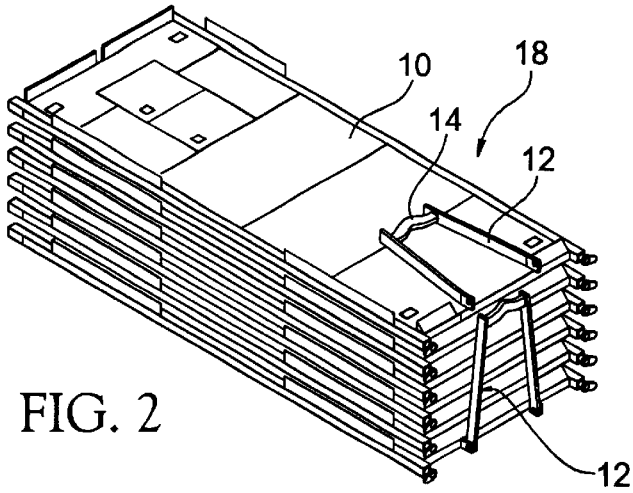
FIG. 2 is a perspective view of a plurality of M3 CROPs shown stacked in retrograde configuration.

The invention will now be described with reference to its preferred use. In this regard, FIG. 1 depicts a standard Container Roll-in/Out Platform (CROP) 10 having an A-frame 12 and a bail bar 14, and is shown configured with a load 16. More specifically, CROP 10 is a flat cargo body having a pivotal A-frame 12, which is designed for use with the Palletized Load System (PLS) truck and trailer. The M3 CROP has a service life of approximately 20 years and is particularly well suited for military application CROP 10 can be configured with a variety of loads, or it can be configured for shipment in a stacked, retrograde configuration 18 as shown in FIG. 2. When so configured, the A-frame 12 of the lower most CROP 10 is preferably in an upright position, and the remainder of A-frames 12 are pivoted downwardly to a horizontal or stowed position. Whether configured for loads as shown in FIG. 1, or in retrograde configuration 18 as shown in FIG. 2, A-frame 12, and specifically bail bar 14 of upright A-frame 12 serves as the manipulation bracket for the PLS truck as will be further described with reference to FIGS. 3 and 4 below.

Figure 3:
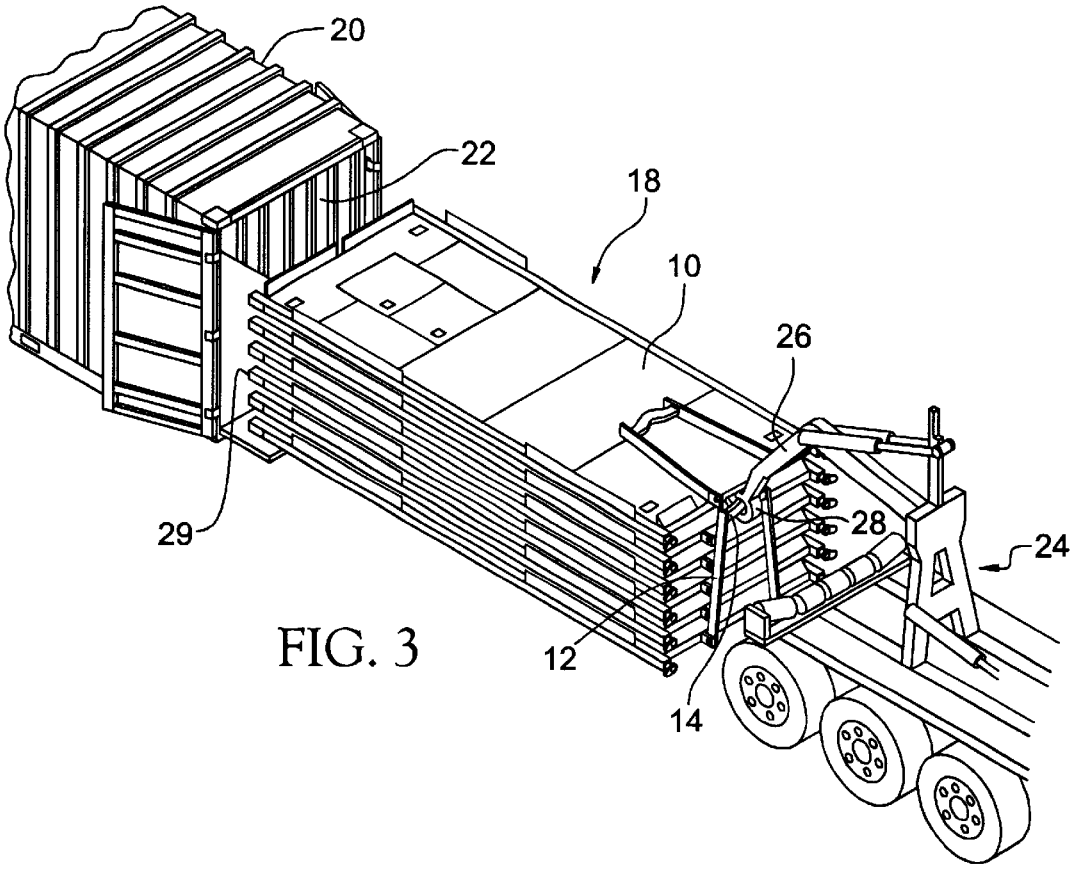
FIG. 3 is a perspective view of a PLS truck shown loading the plurality of CROPs of FIG. 2 into an ISO container.
Figure 4:
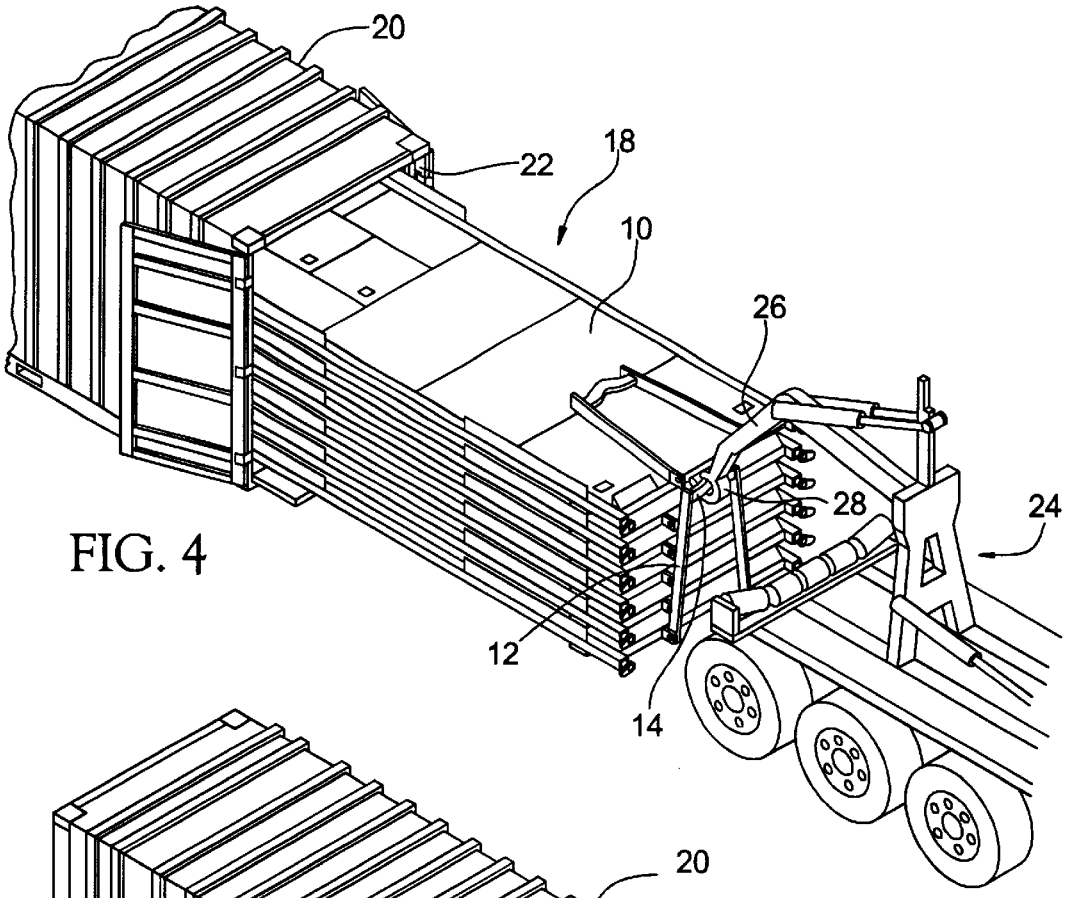
FIG. 4 is a perspective view of a PLS truck shown loading the plurality of CROPs of FIG. 2 further into an ISO container.
Figure 5:
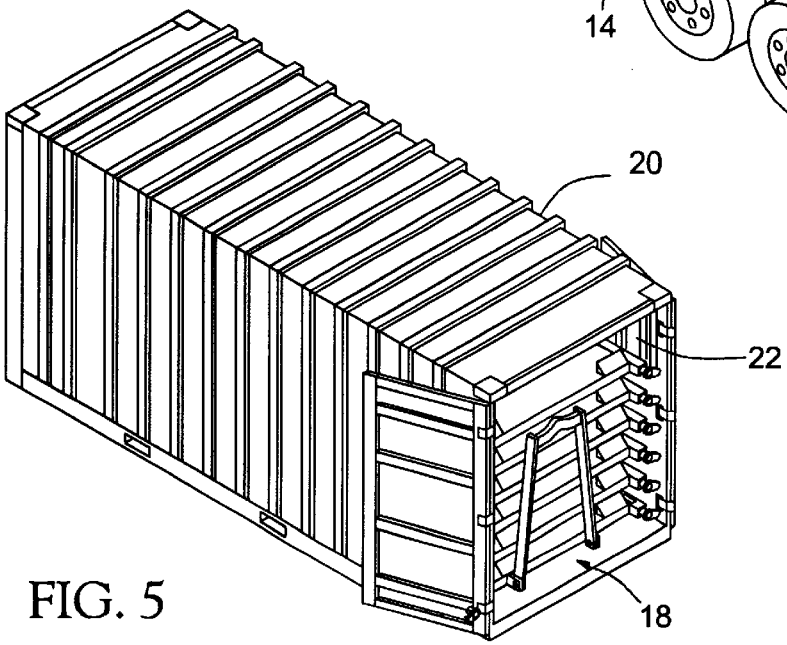
FIG. 5 is a perspective view of the plurality of CROPs of FIG. 2 shown fully inserted within an ISO container.

As shown in FIG. 3, the plurality of CROPs 10 in retrograde configuration 18 are positioned in front of an adjacent ISO container 20, having a storage compartment 22 therein, by PLS truck 24. A loading hook arm 26 having an existing hook 28 is used to engage bail bar 14 to facilitate movement of retrograde configuration 18 of CROPs 10. As shown in FIG. 3, rear 29 of retrograde configuration 18 is slowly maneuvered into storage compartment 22 of ISO container 20 by PLS truck 24, and specifically by loading hook arm 26. Each CROP 10 typically includes a plurality of rollers (not shown) which facilitate movement of the retrograde configuration 18 or other load (not shown), and could incorporate skids or other devices in lieu of rollers. As shown in FIG. 4, PLS truck 24 continues to move rearward, thereby facilitating insertion of retrograde configuration 18 into ISO container 20. When complete, retrograde configuration 18 or other load (not shown) is fully inserted into storage compartment 22 of ISO container 20.

Although it cannot be fully appreciated by the accompanying drawing figures, the weight of load 16 or plurality of CROPs 10 in retrograde configuration 18 often cause the lower most CROP 10 to bend or sag. As a result, the lower most CROP 10 frequently comes into contact with the ground below and/or the bottom of ISO container 20 during loading and unloading operations. As a result, the function of the rollers (not shown) is often impaired by the CROP 10 to ground contact. When this occurs, the frictional resistance caused thereby necessitates application of additional force by PLS truck 24. Since the force is being applied through existing hook 28 to bail bar 14, A-flame 12 has a tendency to bend in the direction of ISO container 20. As will be described in greater detail below, the deflection of A-frame 12 often results in an incomplete insertion of retrograde configuration 18 or other loads into storage compartment 22 of ISO container 20. When not fully inserted, retrograde configuration 18 or other loads cannot be properly secured within ISO container 20, and alternative vehicles and/or devices are typically required to complete the CROP insertion.

While the foregoing detailed description has been set forth with reference to a standard M3 CROP, NSS 3990-01442-2751, it will be understood by those skilled in the art that the present invention is applicable for use with a standard M3A1 CROP, NSN 3990-01450-5671, and other loading platforms as well. Further details relating to both the M3 CROP, and the M3A1 CROP, to include loading and unloading procedures of each using the Load Handling Systems (LHS) can be found in TM 9-3990-260-14 & P, *Operators, Unit, Direct Support and General Support Maintenance Manual* (*Including Repair Parts and Special Tools List*), Headquarters, Department of the Army, Washington, D.C. (Jul. 1, 1999), which is hereby incorporated by reference herein, in its entirety.

Figure 6:
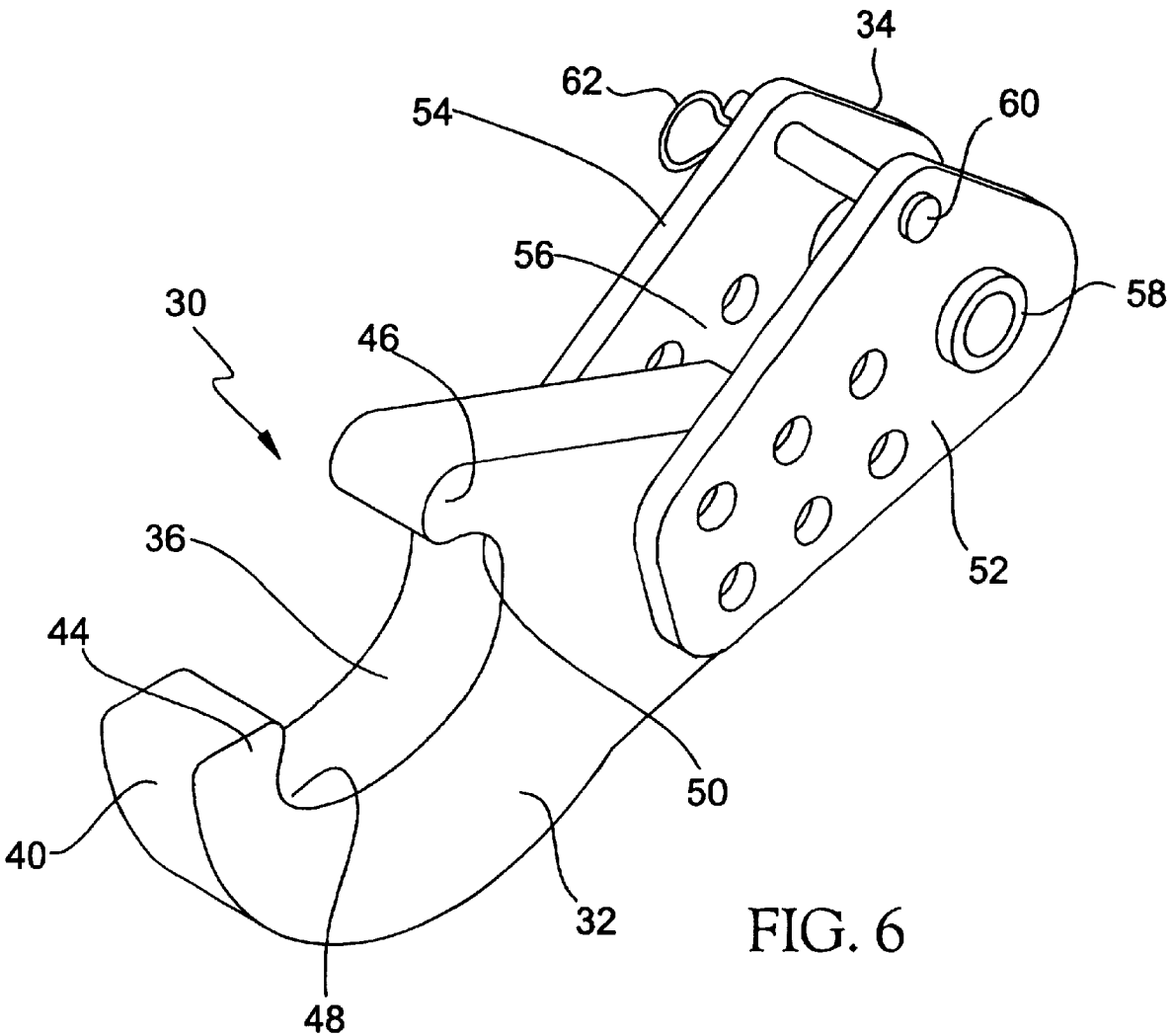
FIG. 6 is a perspective view of a preferred embodiment of the hook assembly of the present invention.

Reference will now be made in detail to the present preferred embodiments of the invention, examples of which are illustrated in the accompanying drawings. Wherever possible, the same reference numerals will be used throughout the drawing figures to refer to the same or like parts. An exemplary embodiment of the hook assembly of the present invention is shown in FIG. 6, and is designated generally throughout by reference numeral 30.

In accordance with the invention, the present invention for extending the reach of transportation load handling systems includes an engagement member 32 for engaging the platform to be loaded, and a locking assembly 34 for securing hook assembly 30 to existing hook 28 of a loading vehicle, preferably a PLS truck 24. As illustrated in the exploded perspective view of FIG. 7, engagement member 32 includes a recessed substantially C-shaped hook portion 36 adjacent the forward end 40, and a recessed notch 38 adjacent rear end 42. During loading, hook portion 36 generally faces upward while recessed notch 38 is generally downwardly facing. As will be described in greater detail below, recessed notch 38 is preferably sized and shaped to mate with an existing hook of PLS truck 24. Hook portion 36 is preferably shaped to securely engage a loading handle or other appendage of a loading platform. Most preferably, hook portion 36 is sized and shaped to securely engage the bail bar 14 of an M3 CROP or M3A1 CROP (hereinafter "CROP"). More specifically, those portions of engagement member 32 forming the ends of hook portion 36 are specifically adapted to prevent slippage of hook portion 36 from the bail bar. Accordingly, both the front flange or lip 44 and rear flange or lip 46 of engagement member 32 are turned inward to form front recess 48 and rear recess 50, respectively, in which bail bar is seated during loading and unloading operations.

Figure 7:
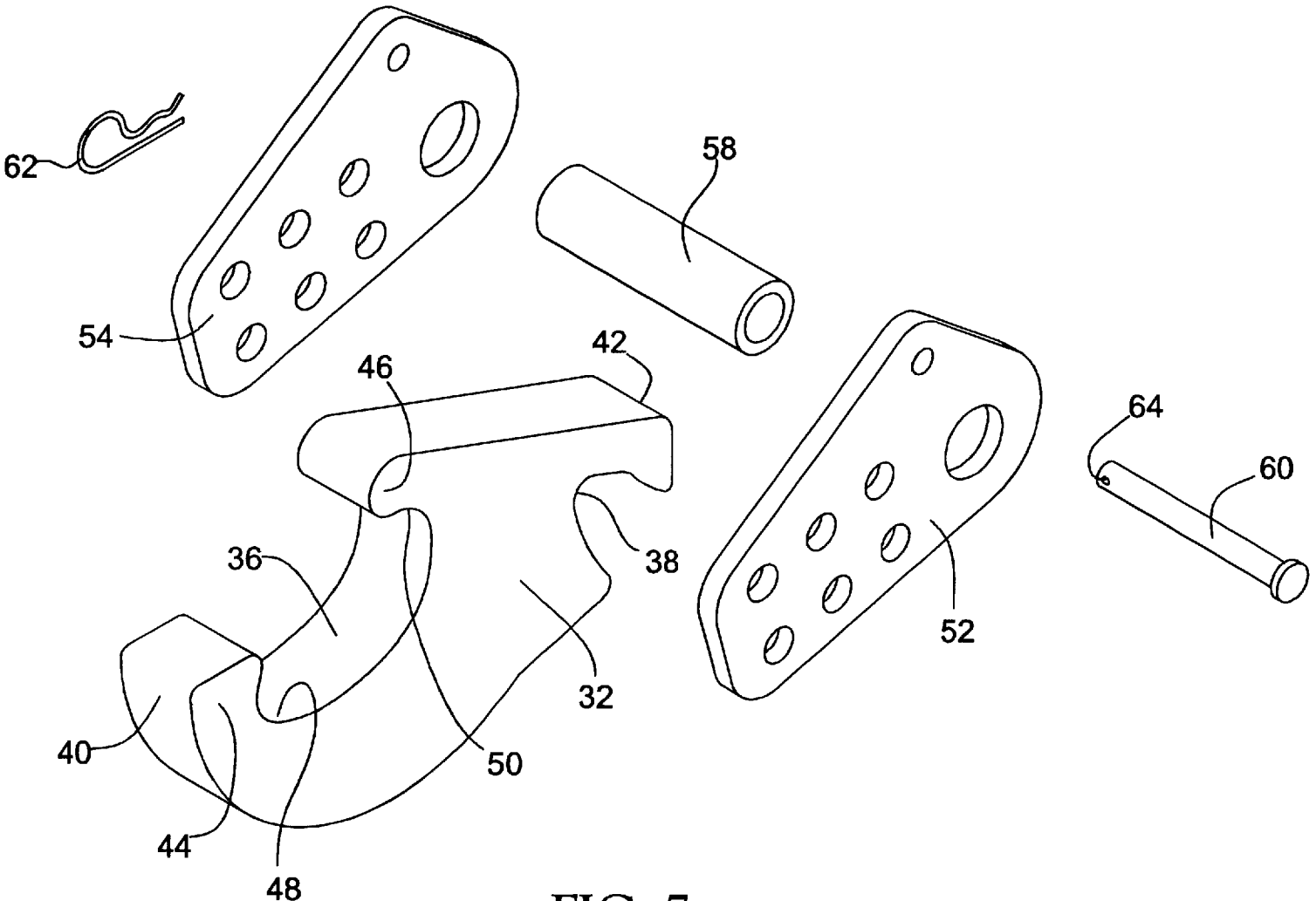
FIG. 7 is an exploded perspective view of the hook assembly of FIG. 6.

FIG. 7 also depicts various components of locking assembly 34. In a preferred embodiment, locking assembly 34 includes a pair of opposed plates 52 and 54 that are mounted on the rear portion of engagement member 32 such that they form at least partial side walls for recessed notch 38, as shown in FIG. 6. First plate 52 and second plate 54 are preferably welded to engagement member 32, but it will be understood by those skilled in the art that other fastening methods and devices can be used to secure the opposed plates 50 and 52 to engagement member 32. It is envisioned that, for certain applications, a hinged connection between opposed plates 50 and 52, and engagement member 32 will be desired and/or necessary.

First plate 52 and second plate 54 preferably lie in parallel planes and define a passageway 56 (FIG. 6) therebetween. Spanning passageway 56 and connecting first plate 52 to second plate 54 is preferably a tubular rod 58. As will be described in greater detail below, tubular rod 58, and recessed notch 38 cooperate with the existing hook of a loading device to secure hook assembly 30 to the existing hook. Locking pin 60 and cotter pin 62 (connected to locking pin 60 through bore 64) preferably cooperate with locking assembly 34 to selectively lock hook assembly 30 into engagement with an existing hook.

The operation of the hook assembly 30 will now be described with reference to a standard loading hook arm 26 of a PLS truck 24, such as loading hook arm 26 depicted in FIGS. 8 and 9. Loading hook arm 26 incorporates an existing hook 28 that is used to manipulate loading platforms such as CROPs 10. As described above, however, one of the shortcomings of loading hook arm 26 is that the arm itself and specifically a face portion 70 of loading hook arm 26 often contacts the top of ISO container 20 prior to complete insertion of CROP 10.

Hook assembly 30 of the present invention overcomes this shortcoming by extending the reach of existing hook 28 Said differently, the attachment of hook assembly 30 to existing hook 28 positions hook portion 36 further forward of face portion 70 of loading hook arm 26. As a result, a loading platform such as a CROP can be fully inserted into an ISO container 20 before face portion 70 has an opportunity to strike the top of ISO container 20, and thereby limit the container's forward progress.

Figure 8:
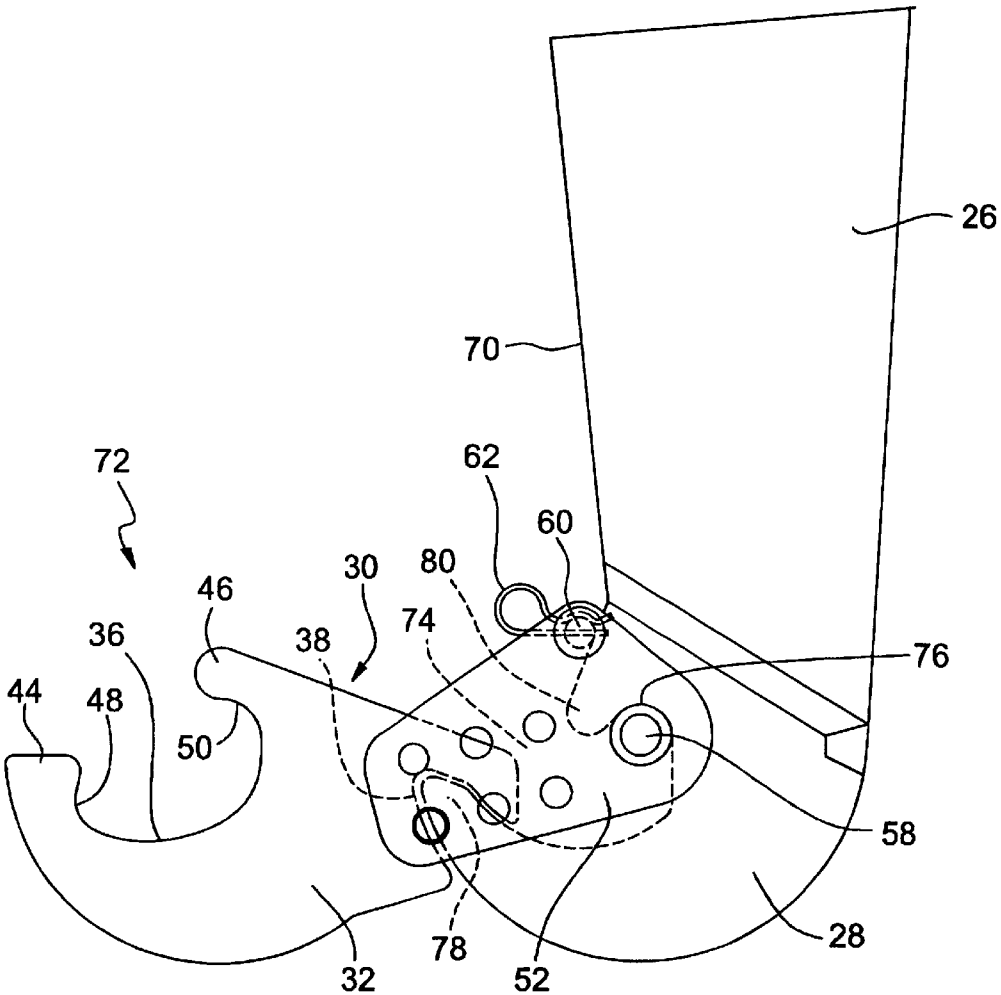
FIG. 8 is a side elevational view of the hook assembly of FIG. 6 shown mounted on the hook arm of the PLS truck depicted in FIGS. 3 and 4.
Figure 9:
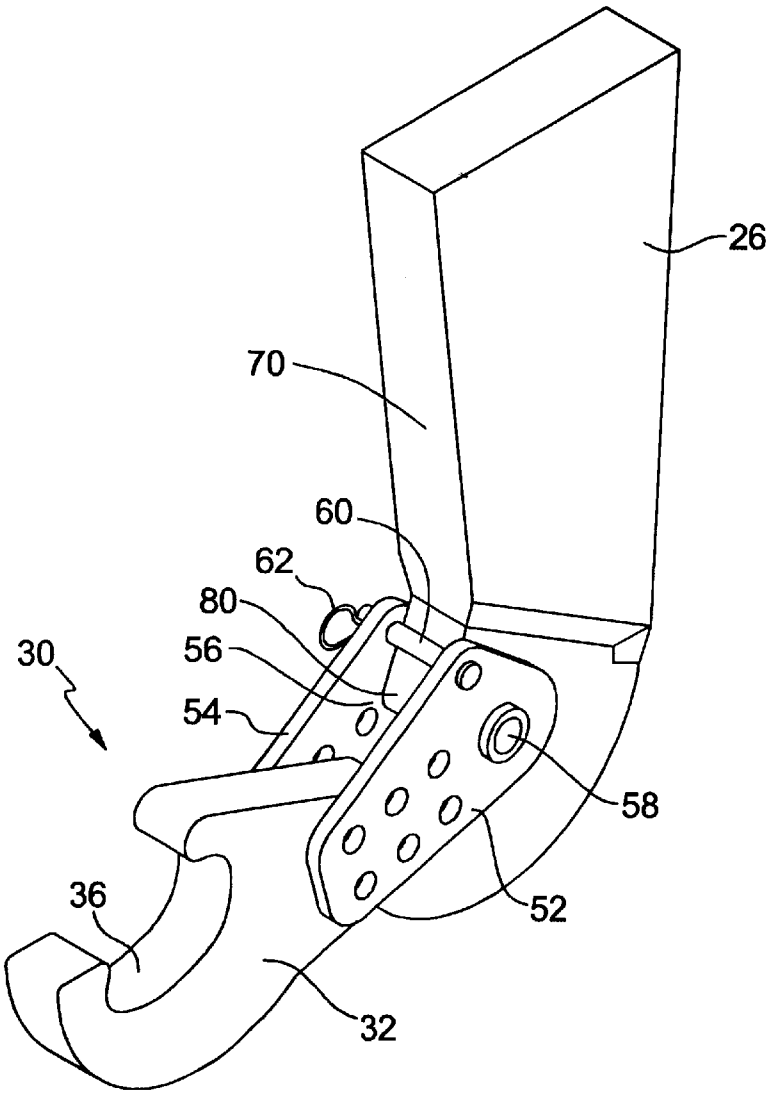
FIG. 9 is a perspective view of the hook assembly of FIG. 6 shown mounted on the hook arm in accordance with the present invention.

As shown in FIG. 8, hook assembly 30 is preferably rotated or pivoted into engagement with existing hook 28 as indicated by directional arrow 72. Tubular rod 58 is preferably maneuvered into existing hook 28 through opening 74, and hook assembly 30 is then rotated as shown by directional arrow 72 so that tubular rod 58 is seated within bracing recess 76 of existing hook 28, and so that existing hook tip 78 is received within recessed notch 38 of engagement member 32. At least the lip portion 80 of existing hook 28 is received in passageway 56 (FIG. 9) formed between locking assembly plates 52 and 54. It is preferred that locking pin 60 is passed through the first plate 52 and second plate 54 and secured with cotter pin 62 such that locking pin 60 spans passageway 56 above lip portion 80 of existing hook 28. Together, locking pin 60, tubular rod 58, notch 38, and first and second plates 52 and 54 prevent unintended separation of hook assembly 30 from existing hook 28 that might otherwise result from the various forces acting on hook assembly 30 during loading and unloading operations.

During loading operations (not shown), bail bar 14 of CROP 10 is received in hook portion 36 of engagement member 32. When force is applied to hook assembly 30 by PLS truck 24, bail bar 14 is seated in rear recess 50 of hook portion 36 and CROP 10 is securely loaded onto ISO container 20. Similarly, during unloading operations (not shown) bail bar 14 is received in hook portion 36 of engagement member 32. As PLS truck 24 begins to extract CROP 10 from ISO container 20, bail bar 14 is seated in front recess 48 of hook portion 36 and CROP 10 is extracted from ISO container 20 without bail bar 14 becoming disengaged from front recess 48. The novel shape of front flange 44 and rear flange 46 of engagement member 32 function to maintain bail bar 14 within front recess 48 and rear recess 50, respectively, during both loading and unloading operations. Moreover, the cooperation of tubular rod 58 and locking pin 60 ensures that existing hook tip 78 does not rotate or slip out of engagement with recessed notch 38 of engagement member 32. The result is a rigid and sturdy connection between hook assembly 30 and existing hook 28, which facilitates the complete and expedient insertion and removal of CROP 10 from ISO container 20.

It will be apparent for those skilled in the art that various modifications and variations can be made to the present invention without departing from the spirit and scope of the invention. For instance, hook assembly 30 could be either removably or fixedly constructed on existing hook 28 from separate components using various fastening devices rather than being attached rotatably as described above. Moreover, locking assembly 24 could be a unitary component incorporating some form of spring loaded or hinged locking device rather than locking pin 60 and cotter pin 62. Thus, it is intended that the present invention cover the modifications and variations of this invention provided they come within the scope of the appended claims and their equivalents.

What is claimed is:

1. A hook assembly for extending the reach of an existing hook of a loading device, said assembly comprising:

a member including a hook sized and shaped to mate with an apparatus to be loaded and a notch opposite said hook for receiving the tip of the existing hook; and an elongated locking assembly depending from said member, said locking assembly constructed and arranged to secure said member to the existing hook of the loading device, and to extend the reach of the existing hook.

2. The assembly of claim 1 wherein said locking assembly is pivotally received on the existing hook.

3. The assembly of claim 1 wherein said locking assembly comprises:

a pair of opposed plates mounted on opposite sides of said member, said opposed plates defining a channel therebetween for receiving at least a portion of the existing hook; and a tubular rod substantially perpendicular to and connecting said pair of opposed plates at a location remote from said member.

4. The assembly of claim 3 wherein said tubular rod is positioned with respect to said member to engage the base of the existing hook to prevent pivotal movement of said member in a first direction during loading operations.

5. The assembly of claim 3 wherein said member further includes a notch opposite said hook for receiving the tip of the existing hook, and wherein said pair of opposed plates are positioned on said member such that said pair of opposed plates and said notch define a slot sized and shaped to receive the tip of the existing hook.

6. The assembly of claim 5 wherein said opposed plates are positioned with respect to said member and said notch such that lateral movement of said member along the tip of the existing hook is prevented during loading operations.

7. A hook assembly for extending the reach of an existing hook of a loading device, said assembly comprising:

a member including a hook sized and shaped to mate with an apparatus to be loaded; and an elongated locking assembly depending from said member, said locking assembly constructed and arranged to secure said member to the existing hook of the loading device, and to extend the reach of the existing hook, a locking pin cooperating with said locking assembly to detachably lock said member to the existing hook, said locking pin positioned with respect to said member to impede pivotal movement of said member during loading operations.

8. A method of extending the reach of an existing hook of a loading device, said method comprising the steps of:

guiding a hook assembly comprising a member including a hook and a locking assembly depending from said member onto the existing hook of the loading device;

pivoting said hook assembly with respect to the existing hook such that said locking assembly engages the base of the existing hook, and such that said member receives the tip of the existing hook; and fastening said hook assembly to the existing hook to prevent unintended separation of said hook assembly from the existing hook.

9. The method of claim 8 wherein said locking assembly comprises a pair of opposed plates mounted on opposite sides of said member and a tubular rod extending between and connecting said plates, and wherein the guiding step comprises the step of passing the tubular rod into the existing hook and against the base of the existing hook.

10. The method of claim 9 wherein said locking assembly includes a locking pin, and wherein said fastening step comprises the step of passing the locking pin through the pair of opposed plates such that a portion of the existing hook is wedged between said tubular rod and said locking pin.

11. The method of claim 10 wherein said locking pin includes a transverse bore at one of its ends, the method further comprising the step of sliding a cotter pin into the bore to detachably secure said locking pin to said locking assembly.

12. The method of claim 8 wherein said member further includes a notch opposite said hook, and wherein said pivoting step includes the step of rotationally moving said member downward such that the tip of the existing hook is received in said notch.

* * * * *